US009063487B2

(12) United States Patent
Isoe et al.

(10) Patent No.: US 9,063,487 B2
(45) Date of Patent: Jun. 23, 2015

(54) FIXING DEVICE AND IMAGE FORMING APPARATUS INCORPORATING SAME

(71) Applicants: Yukari Isoe, Kanagawa (JP); Motokazu Hasegawa, Kanagawa (JP); Masanobu Yamagata, Kanagawa (JP)

(72) Inventors: Yukari Isoe, Kanagawa (JP); Motokazu Hasegawa, Kanagawa (JP); Masanobu Yamagata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/168,179

(22) Filed: Jan. 30, 2014

(65) Prior Publication Data

US 2014/0233994 A1 Aug. 21, 2014

(30) Foreign Application Priority Data

Feb. 19, 2013 (JP) ..... 2013-029800

(51) Int. Cl.
*G03G 15/20* (2006.01)

(52) U.S. Cl.
CPC .... *G03G 15/2053* (2013.01); *G03G 2215/2032* (2013.01)

(58) Field of Classification Search
CPC ..... G03G 15/2017; G03G 15/2053
USPC ..... 399/328, 329
See application file for complete search history.

(56) References Cited

U.S. PATENT DOCUMENTS

| | | | | |
|---|---|---|---|---|
| 2006/0285893 | A1 | 12/2006 | Ishii | |
| 2009/0242813 | A1* | 10/2009 | Hirata et al. | 251/129.01 |
| 2011/0243621 | A1* | 10/2011 | Gon | 399/328 |
| 2012/0155933 | A1 | 6/2012 | Hasegawa et al. | |
| 2012/0177418 | A1 | 7/2012 | Hashiyada et al. | |
| 2012/0201558 | A1* | 8/2012 | Watanabe | 399/69 |
| 2012/0230743 | A1 | 9/2012 | Matsusaka et al. | |

FOREIGN PATENT DOCUMENTS

| | | |
|---|---|---|
| JP | 2006-350054 | 12/2006 |
| JP | 2007-264021 | 10/2007 |
| JP | 2011-232734 | 11/2011 |
| JP | 2012-141589 | 7/2012 |
| JP | 2012-159829 | 8/2012 |
| JP | 2012-198493 | 10/2012 |

* cited by examiner

*Primary Examiner* — Gregory H Curran
(74) *Attorney, Agent, or Firm* — Oblon, McClelland, Maier & Neustadt, L.L.P.

(57) ABSTRACT

A fixing device includes a rotatable fixing member, a pressing member, and an induction heater. The induction heater includes an excitation coil, ferromagnetic cores, and a holder. The ferromagnetic cores include multiple arch cores and multiple side cores. The multiple arch cores are disposed facing an outer surface of a heat generation layer with the excitation coil interposed therebetween. The multiple side cores are disposed outside the excitation coil in a longitudinal direction of the induction heater so as to face both ends of each of the multiple arch cores. The multiple side cores are integrally inserted in the holder. The holder includes a spacer. The spacer contains a resin material used in the holder and provided in a close-facing portion located between at least one of the multiple arch cores and at least one of the multiple side cores to form a gap.

8 Claims, 11 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2013-029800, filed on Feb. 19, 2013, in the Japan Patent Office, the entire disclosure of which is hereby incorporated by reference herein.

BACKGROUND

1. Technical Field

Embodiments of this disclosure generally relate to a fixing device employing an electromagnetic induction heating method and an image forming apparatus incorporating the fixing device.

2. Related Art

Image forming apparatuses, such as copiers, printers, facsimile machines, or multifunction machines having two or more of copying, printing, scanning, facsimile, plotter, and other functions, may incorporate a fixing device employing an electromagnetic induction heating method to reduce startup time of the image forming apparatuses, thereby enhancing the energy efficiency.

For example, JP-2006-350054-A discloses a fixing device employing the electromagnetic induction heating method. The fixing device includes, e.g., a support roller (or a heating roller) serving as a heat generation body, an auxiliary fixing roller (or a fixing roller), a fixing belt stretched over the support roller and the auxiliary fixing roller, an induction heater serving as an induction heating unit and facing the support roller via the fixing belt, and a pressing roller to contact the auxiliary fixing roller via the fixing belt.

The induction heater includes, e.g., a coil (or an excitation coil) wound in a longitudinal direction of the induction heater, and cores (or coil cores) disposed around the coil. The induction heater faces and heats the fixing belt. The heated fixing belt heats and fixes a toner image formed on a recording medium conveyed between the auxiliary fixing roller and the pressing roller. Specifically, a high-frequency alternating current supplied to the coil forms an alternating magnetic field around the coil, which generates eddy currents on a surface of the support roller and its neighboring area. When the eddy currents are generated around the support roller serving as a heat generation body, the electrical resistance of the support roller leads to Joule heating of the support roller, thereby heating the fixing belt stretched over the support roller.

In such a fixing device employing the electromagnetic induction heating method, the heat generation body is directly heated by electromagnetic induction. Accordingly, compared to a typical fixing device using a halogen heater, the fixing device employing the electromagnetic induction heating method has a higher heat-exchange efficiency and therefore the surface temperature of the fixing belt can be increased to a desired fixing temperature more efficiently, that is, with less energy and a shorter startup time.

To obtain a uniform temperature distribution, JP-2007-264021-A provides an air gap between a side core and an arch core. Such a gap lengthens a magnetic path passing through a nonmagnetic material and therefore increases an amount of leaked magnetic flux. Consequently, the corresponding amount of heat generation is reduced. Therefore, the air gap is provided at a portion where the temperature is high. By contrast, the air gap is not provided at a portion where the temperature is low. Such a way of determining gaps between side cores and arch cores is usually employed to obtain a uniform temperature distribution.

FIG. 4 of JP-2007-264021-A illustrates an air gap 52 provided between an arch core 35b and a side core 33 with a core holder 44. The size of the air gap 52 is determined according to temperature distribution. However, the size determination involves a change to the size of the arch core 35b. Consequently, multiple arch cores 35b having different sizes are used to determine the gap size. Thus, the number of components increases and therefore production costs increases. In addition, cores obtained by sintering compressed ferrite powder contract in a sintering process. Hence, arch cores are likely to warp, causing a difference in size among the arch cores. Consequently, gaps may be created in different sizes, hampering uniform temperature distribution.

SUMMARY

This specification describes below an improved fixing device. In one embodiment of this disclosure, the fixing device includes a rotatable fixing member, a pressing member to press against the fixing member, and an induction heater serving as a heating source to heat the fixing member. The rotatable fixing member includes one of a roller and a belt. The induction heater includes an excitation coil to inductively heat a heat generation layer, ferromagnetic cores to form a continuous magnetic path to direct magnetic flux arising from the excitation coil to a predetermined position, and a holder to hold the excitation coil and the ferromagnetic cores. The ferromagnetic cores include multiple arch cores and multiple side cores. The multiple arch cores are disposed facing an outer surface of the heat generation layer with the excitation coil interposed therebetween. The multiple side cores are disposed outside the excitation coil in a longitudinal direction of the induction heater so as to face both ends of each of the multiple arch cores. The multiple side cores are integrally inserted in the holder. The holder includes a spacer. The spacer contains a resin material used in the holder and provided in a close-facing portion located between at least one of the multiple arch cores and at least one of the multiple side cores to form a gap.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
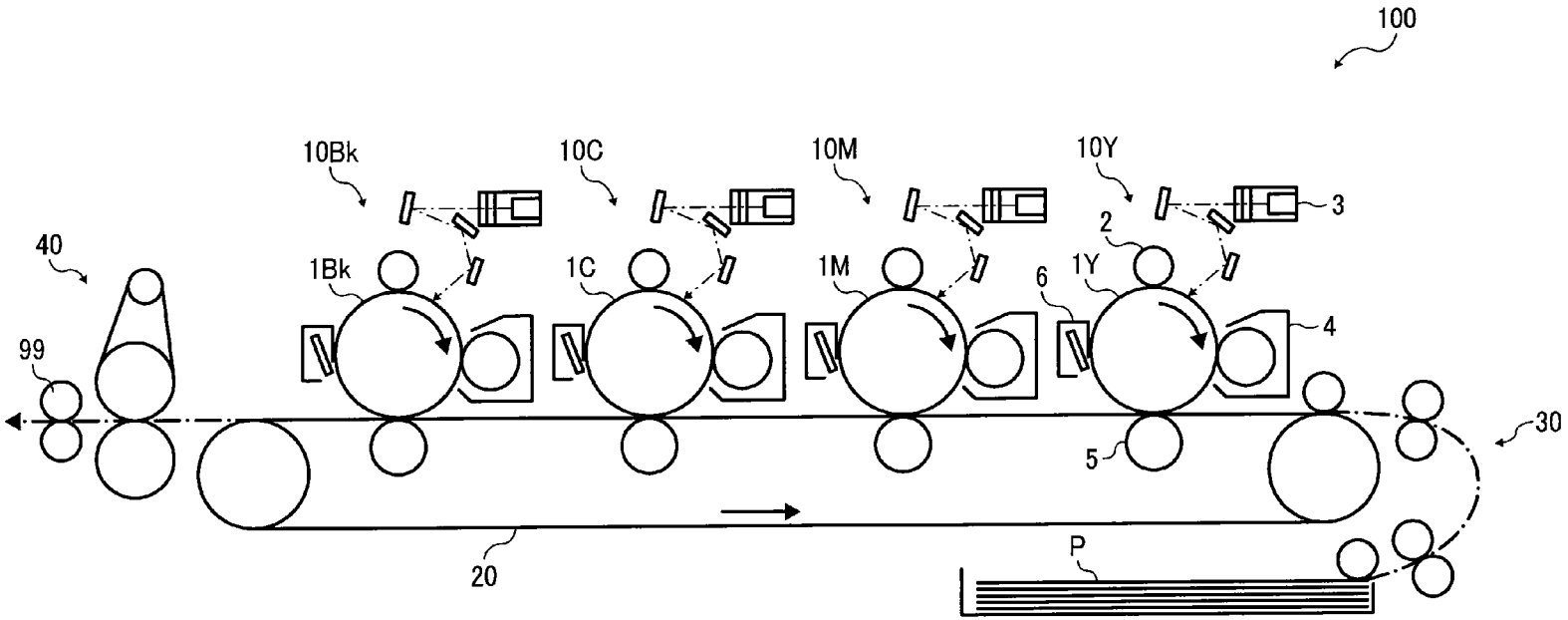
FIG. 1 is a schematic view of an image forming apparatus according to embodiments of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals will be given to identical or corresponding constituent elements such as parts and materials having the same functions, and redundant descriptions thereof will be omitted unless otherwise required.

Referring now to the drawings, wherein like reference numerals designate identical or corresponding parts throughout the several views, embodiments of this disclosure are described below.

Initially with reference to FIG. 1, a description is given of an entire configuration and operation of an image forming apparatus 100 according to embodiments of this disclosure. It is to be noted that, in the following description, suffixes Y, M, C, and Bk denote colors yellow, magenta, cyan, and black, respectively.

FIG. 1 is a schematic view of the image forming apparatus 100 according to embodiments of this disclosure.

The image forming apparatus 100, herein serving as a printer, includes four imaging stations 10Y, 10M, 10C, and 10Bk serving as imaging units and employing an electrophotographic method. The imaging stations 10Y, 10M, 10C, and 10Bk include photoconductive drums 1Y, 1M, 1C, and 1Bk serving as image carriers, and form toner images of yellow, magenta, cyan, and black on surfaces of the photoconductive drums 1Y, 1M, 1C, and 1Bk, respectively.

A conveyance belt 20 is disposed below the imaging stations 10Y, 10M, 10C and 10Bk to convey a sheet P serving as a recording medium through the imaging stations 10Y, 10M, 10C and 10Bk. The photoconductive drums 1Y, 1M, 1C, and 1Bk of the respective imaging stations 10Y, 10M, 10C and 10Bk are disposed to contact the conveyance belt 20 while rotating. The sheet P electrostatically adheres to a surface of the conveyance belt 20.

It is to be noted that the four imaging stations 10Y, 10M, 10C, and 10Bk have similar configurations. Hence, a description is herein given only of the imaging station 10Y employing the yellow color, which is disposed at a most upstream end in a direction in which the sheet P is conveyed, as a representative example of the imaging stations 10Y, 10M, 10C and 10Bk. Specific descriptions of the imaging stations 10M, 10C and 10Bk are herein omitted, unless otherwise required.

The imaging station 10Y includes the photoconductive drum 1Y disposed substantially at a center of the imaging station 10Y. The photoconductive drum 1Y contacts the conveyance belt 20 while rotating. The photoconductive drum 1Y is surrounded by various pieces of imaging equipment, such as a charging device 2Y, an exposure device 3Y, a developing device 4Y, a transfer roller 5Y, a drum cleaner 6Y, and a charge neutralizing device, disposed sequentially along a direction of rotation of the photoconductive drum 1Y. The charging device 2Y charges the surface of the photoconductive drum 1Y so that a predetermined electric potential is created on the surface of the photoconductive drum 1Y. The exposure device 3Y directs light to the charged surface of the photoconductive drum 1Y according to an image signal after color separation to form an electrostatic latent image on the surface of the photoconductive drum 1Y. The developing device 4Y develops the electrostatic latent image thus formed on the surface of the photoconductive drum 1Y with toner of yellow, thereby forming a visible image, also known as a toner image of yellow. The transfer roller 5Y, serving as a transfer device, transfers the toner image thus developed onto the sheet P conveyed by the conveyance belt 20. The drum cleaner 6Y removes residual toner remaining on the surface of the photoconductive drum 1Y after a transfer process. The charge neutralizing device removes residual charge from the surface of the photoconductive drum 1Y.

A sheet-feeding unit 30 is disposed to the right of the conveyance belt 20, at a bottom right in FIG. 1, to feed the sheet P onto the conveyance belt 20.

In addition, a fixing device 40 according to an embodiment is disposed to the left of the conveyance belt 20 in FIG. 1. The sheet P conveyed by the conveyance belt 20 is then continuously conveyed to the fixing device 40 through a conveyance path, which extends from the conveyance belt 20 through the fixing device 40.

The fixing device 40 applies heat and pressure to the sheet P thus conveyed, on a surface of which the toner images of yellow, magenta, cyan, and black are transferred. Thus, the fixing device 40 fuses the toner images of yellow, magenta, cyan, and black so that the toner images of yellow, magenta, cyan, and black permeate the sheet P, thereby fixing the toner images of yellow, magenta, cyan, and black onto the sheet P. The sheet P is then discharged by a pair of discharging rollers 99 disposed on a downstream side of the conveyance path passing through the fixing device 40. Thus, a series of image formation process is completed.

Figure 2:
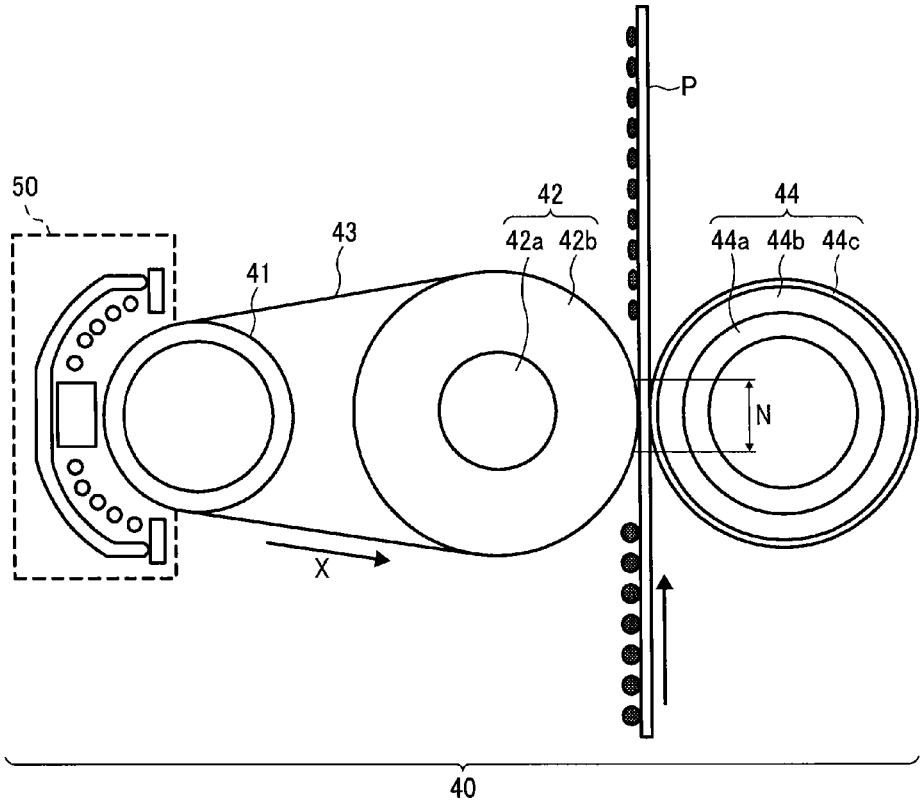
FIG. 2 is a schematic sectional view of a fixing device according to a first embodiment incorporated in the image forming apparatus of FIG. 1.

Referring now to FIG. 2, a detailed description is given of a fixing device 40 according to a first embodiment.

FIG. 2 is a schematic sectional view of the fixing device 40 according to the first embodiment incorporated in the image forming apparatus 100 described above. As illustrated in FIG. 2, the fixing device 40 includes, e.g., a heating roller 41, a fixing roller 42, a fixing belt 43, a pressing roller 44, and an induction heater 50.

The heating roller 41 contains a metallic material such as stainless steel, aluminum, or iron. The heating roller 41 may contain a material that does not affect induction heating, by having a metal core layer of a nonmagnetic and insulative material such as ceramic. According to the first embodiment, the heating roller 41 contains nonmagnetic stainless steel. The heating roller 41 includes a metal core having a thickness of about 0.2 mm to about 1 mm. A surface of the metal core of the heating roller 41 is covered by a heat generation layer. The heat generating layer contains copper (Cu) and has a thickness of about 3 μm to about 15 μm to enhance the efficiency of heat generation. Preferably, the surface of the heat generation layer is nickel-plated to prevent rust.

Alternatively, the heating roller 41 may contain a magnetic shunt alloy having a Curie point of about 160° C. to about 220° C. An aluminum member is disposed inside the magnetic shunt alloy to stop a temperature rise around the Curie point.

The fixing roller 42 includes a metal core 42*a* and an elastic member 42*b*. The metal core 42*a* contains, e.g., stainless steel or carbon steel. The elastic member 42*b* contains, e.g., solid or foam heat-resistant silicone rubber to coat the metal core 42*a*. The pressing roller 44 contacts the fixing roller 42 while applying pressure to the fixing roller 42. Thus, a fixing nip N having a predetermined width is formed between the fixing roller 42 and the pressing roller 44. The fixing roller 42 has an outer diameter of about 30 mm to about 40 mm. The elastic member 42*b* has a thickness of about 3 mm to about 10 mm and a JIS-A hardness of about 10° to about 50°.

Figure 3:
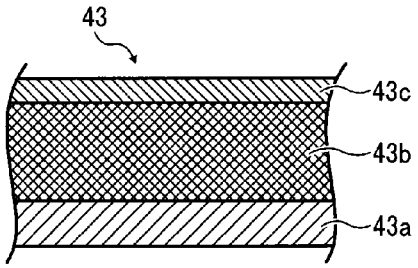
FIG. 3 is a partial sectional view of a fixing belt incorporated in the fixing device of FIG. 2.

Referring now to FIG. 3, a detailed description is given of the fixing belt 43 serving as a fixing member.

FIG. 3 is a sectional view of the fixing belt 43 incorporated in the fixing device 40 described above.

The fixing belt 43 includes a substrate 43*a*, an elastic layer 43*b* and a release layer 43*c*. As illustrated in FIG. 3, the elastic layer 43*b* rests on the substrate 43*a*, and the release layer 43*c* rests on the elastic layer 43*b*.

The substrate 43*a* has characteristics such as mechanical strength and flexibility when the fixing belt 43 is stretched, and resistance against heat at a fixing temperature. According to the first embodiment, the heating roller 41 serving as a heat generation member is inductively heated. Hence, the substrate 43*a* of the fixing belt 43 stretched over the heating roller 41 preferably contains an insulating heat-resistant resin material such as polyimide, polyimide-amide, polyether-ether ketone (PEEK), polyether sulfide (PES), polyphenylene sulfide (PPS), or fluorine resin. The substrate 43*a* preferably has a thickness of about 30 μm to about 200 μm for heat capacity and strength.

The elastic layer 43*b* is employed to give flexibility to a surface of the fixing belt 43 to obtain a uniform image without uneven glossiness. Hence, the elastic layer 43*b* preferably has a JIS-A hardness of about 5° to about 50° and a thickness of about 50 μm to about 500 μm. In addition, the elastic layer 43*b* contains a material of, e.g., silicone rubber or fluorosilicone rubber for resistance against heat at a fixing temperature.

The release layer 43*c* contains a material of, e.g., fluorine resin such as tetrafluoride ethylene resin (PTFE), tetrafluoride ethylene-perfluoroalkyl vinylether copolymer resin (PFA) and tetrafluoride ethylene-hexafluoride propylene copolymer (FEP), combinations of the foregoing resin materials, or heat-resistant resin in which the foregoing fluorine resin is dispersed.

By coating the elastic layer 43*b* with the release layer 43*c*, releasing performance of toner can be enhanced without using silicone oil, thereby preventing paper dust from sticking to the fixing belt 43 and realizing an oil-less system. However, the resin having the releasing performance does not typically have elasticity like a rubber material. Accordingly, if a thick release layer 43*c* is formed on the elastic layer 43*b*, the flexibility of the surface of the fixing belt 43 might be lost to an extent, causing uneven glossiness. To obtain both flexibility and releasing performance, the release layer 43*c* has a thickness of about 5 μm to about 50 μm, and preferably about 10 μm to about 30 μm.

Optionally, a primer layer may be provided between the foregoing layers. A durable layer may be provided on an inner surface of the substrate 43*a* to enhance sliding durability against the heating roller 41 and the fixing roller 42.

Preferably, a heat generation layer may be disposed on the substrate 43*a*. For example, a layer made of copper (Cu) having a thickness of about 3 μm to about 15 μm may be formed on a base layer containing, e.g., polyimide to be used as a heat generation layer.

Referring back to FIG. 2, the pressing roller 44 includes a cylindrical metal core 44*a*, a high heat-resistant elastic layer 44*b*, and a release layer 44*c*. The pressing roller 44 is pressed against the fixing roller 42 via the fixing belt 43 to form the fixing nip N between the pressing roller 44 and the fixing roller 42. The pressing roller 44 has an outer diameter of about 30 mm to about 40 mm. The elastic layer 44*b* has a thickness of about 0.3 mm to about 5 mm and an Asker hardness of about 20° to about 50°. The elastic layer 44*b* contains a heat-resistant material such as silicone rubber. In addition, the release layer 44*c* containing fluorine resin and having a thickness of about 10 μm to about 100 μm is formed on the elastic layer 44*b* to enhance the releasing performance upon two-sided printing operation.

The pressing roller 44 is harder than the fixing roller 42. Hence, the pressing roller 44 is configured to press and be engaged with the fixing roller 42 via the fixing belt 43. Such an engagement gives a curvature to the sheet P sufficient to prevent the sheet P from hugging the surface of the fixing belt 43 when the sheet P exits the fixing nip N. Thus, the releasing performance of the sheet P can be enhanced.

A description is now given of operation of the fixing device 40 configured as described above.

The fixing belt 43 rotates in a direction indicated by an arrow X (i.e., counterclockwise direction) in FIG. 2. The heating roller 41 is heated by the induction heater 50. Specifically, by supplying a high-frequency alternating current of about 10 kHz to about 1 MHz to the excitation coil 51, magnetic lines are generated within a loop of the excitation coil 51 in a manner such that the magnetic lines alternately switch direction. An alternating magnetic field thus formed generates eddy currents and accordingly generates Joule heat on the heating roller 41. Thus, the heating roller 41 is inductively heated. The heating roller 41 thus heated releases heat to the fixing belt 43. The fixing belt 43 thus heated contacts the sheet P conveyed at the fixing nip N to heat and fuse the toner images formed on the sheet P.

Figure 4:
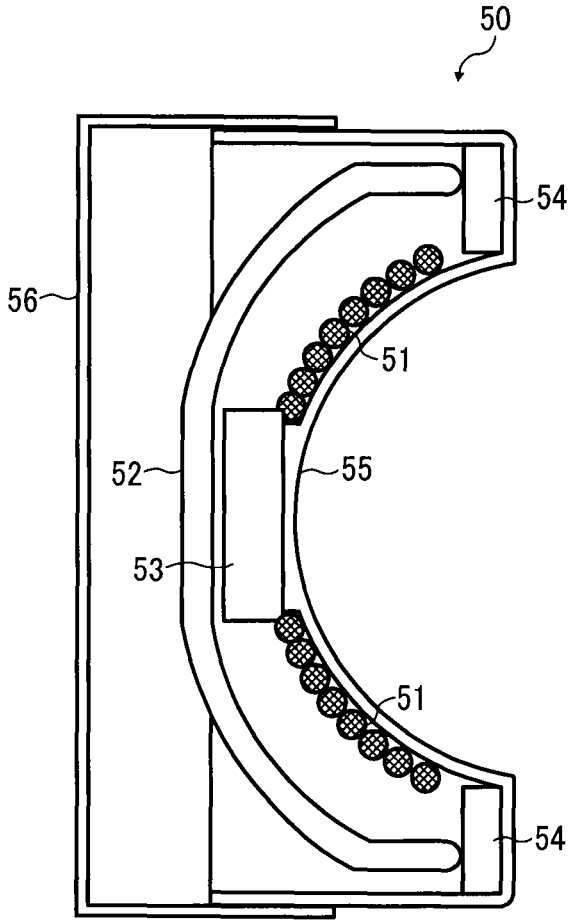
FIG. 4 is a sectional view of an induction heater incorporated in the fixing device of FIG. 2.
Figure 5:
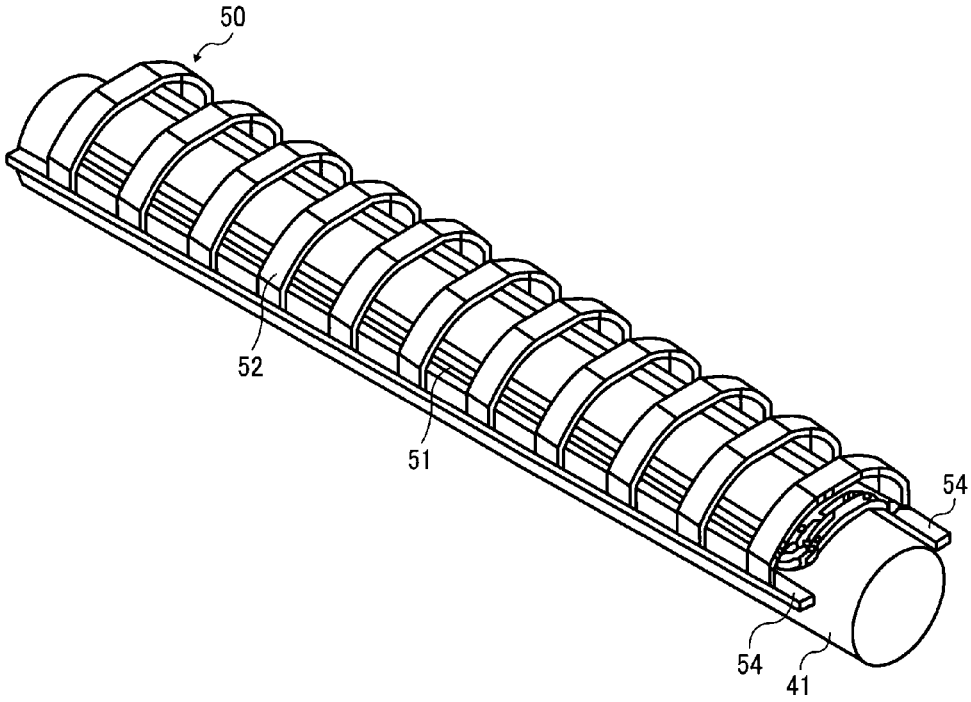
FIG. 5 is a perspective view of a heating roller and the induction heater, illustrating the relative dispositions of the heating roller, an excitation coil and ferromagnetic cores.

Referring now to FIGS. 4 and 5, a description is given of the induction heater 50.

FIG. 4 is a sectional view of the induction heater 50, perpendicular to the axis of the heating roller 41.

FIG. 5 is a perspective view of the heating roller 41 and the induction heater 50, illustrating the relative dispositions of the heating roller 41, the excitation coil 51 and ferromagnetic cores such as arch cores 52 and side cores 54.

As illustrated in FIGS. 4 and 5, the induction heater 50 includes the excitation coil 51, the arch cores 52, a center core 53, the side cores 54, a case 55, and a cover 56. Ferromagnetic cores including the arch cores 52, the center core 53, and the side cores 54 are disposed so as to encompass the excitation coil 51, thereby forming a continuous magnetic path to direct magnetic flux arising from the excitation coil 51 to the heating roller 41 serving as a heat generation member. The center core 53 and the side cores 54 are integrally inserted in the case 55.

Each of the center core 53 and the side cores 54 is a plate-shaped core or a rod-shaped core extending in a longitudinal direction of the induction heater 50 (i.e., axial direction of the heating roller 41). Whereas, each of the arch cores 52 has an arch shape that conforms to the circumferential surface of the heating roller 41 as seen in the axial direction of the heating roller 41. Multiple side cores 54 are disposed outside the excitation coil 51 in a longitudinal direction of the induction heater 50 so as to face both ends of each of the arch cores 52. Multiple arch cores 52 are disposed, facing an outer surface of the heat generation layer of the heating roller 41 serving as a heat generation member with the excitation coil 51 interposed therebetween, at a predetermined interval in a longitudinal direction of the induction heater 50.

The excitation coil 51 is prepared by winding a Litz wire from 5 times to 15 times. The Litz wire includes from about 50 to about 500 conductive wire strands, individually insulated and twisted together. Each conductive wire strand has a diameter of about 0.05 mm to about 0.2 mm. A fusion layer is provided on a surface of the Litz wire. The fusion layer is stiffened by applying heat either by means of supplying power or in a thermostatic oven. Accordingly, a winding shape of the excitation coil 51 can be maintained. Alternatively, the excitation coil 51 may be prepared by winding a Litz wire without a fusion layer, and press-molding the wound Litz wire to reliably maintain the shape of the excitation coil 51. To provide the Litz wire with a resistance against heat at a fixing temperature or higher, resin having insulation performance and heat resistance, such as polyamide-imide or polyimide, may be used as an insulation material to coat the Litz wire.

The windings of the excitation coil 51 are glued to the case 55 with an adhesive, e.g., silicone glue. According to the first embodiment, the case 55 serves as a holder to hold the excitation coil 51 and the ferromagnetic cores. To obtain a resistance against heat at a fixing temperature or higher, the case 55 contains high heat-resistant resin such as polyethylene terephthalate (PET) or liquid crystal polymers.

Each of the ferromagnetic cores contains a ferrite material such as a manganese-zinc (Mn—Zn) ferrite material or a nickel-zinc (Ni—Zn) ferrite material. Ferrite cores are usually made by sintering compressed powder. In such a sintering process, the ferrite cores may contract and warp. Such warping may cause a difference in size of the ferromagnetic cores. It is to be noted that the arch cores 52 and the side cores 54 contacting each other over a larger area prevent or reduce leakage of the magnetic flux in a larger amount and enhance the efficiency of heat generation, allowing the temperature of the heating roller 41 serving as a heat generation member to increase more easily. Accordingly, if the arch cores 52 and the side cores 54 unevenly contact each other due to such a size difference, the uniformity of temperature distribution might be lost in the longitudinal direction of the induction heater 50.

Moreover, other factors such as heat released from ends of the heating roller 41 in the axial direction thereof and/or an interval between the arch cores 52 might cause partial unevenness in the temperature distribution.

Figure 6A:
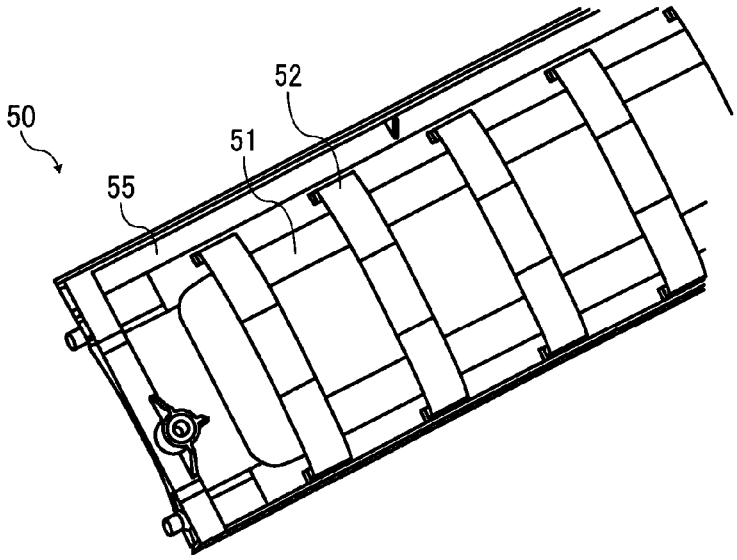
FIG. 6A is a top, perspective view of the induction heater of FIG. 4, partially illustrating a portion in which the excitation coil is disposed.
Figure 6B:
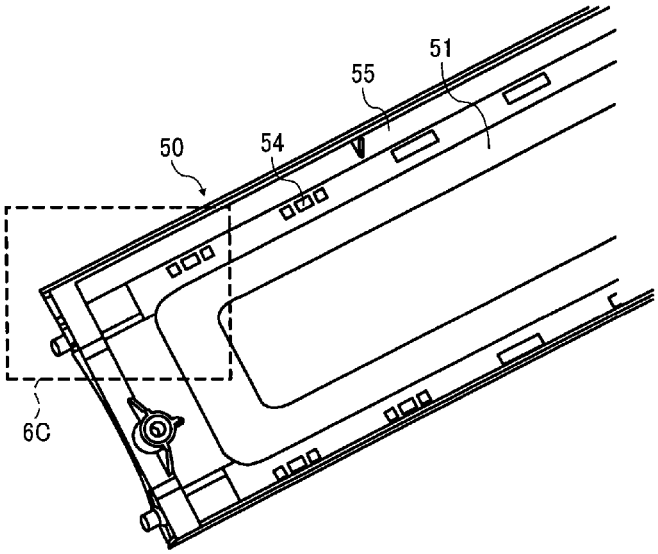
FIG. 6B is a top, perspective view of the induction heater of FIG. 4, partially illustrating the portion in which the excitation coil is disposed with arch cores removed therefrom.
Figure 6C:
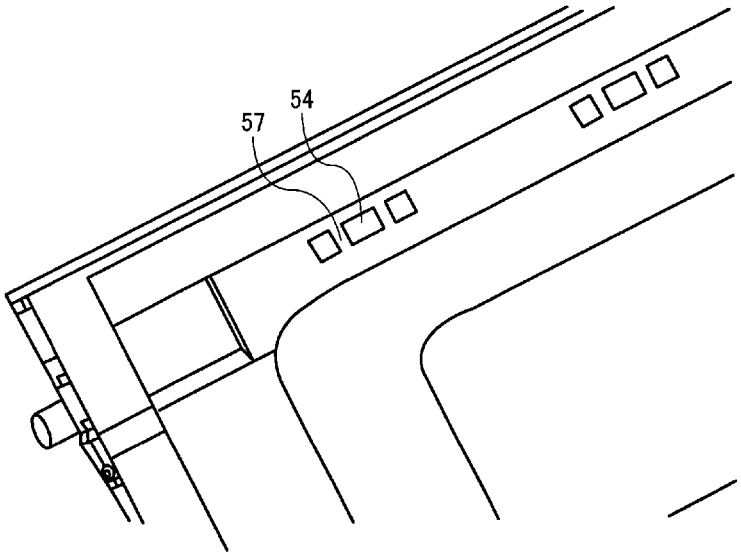
FIG. 6C is a partially enlarged view of the induction heater of FIG. 6B, illustrating a spacer.

To prevent such an uneven temperature distribution, the case 55 includes a spacer 57 to provide a gap in a joining portion (or a close-facing portion) between an arch core 52 and a side core 54, as illustrated in FIG. 6C.

It is to be noted that FIG. 6A is a top, perspective view of the induction heater 50, specifically illustrating a portion in which the excitation coil 51 is disposed. FIG. 6B is a top, perspective view of the induction heater 50, partially illustrating the portion in which the excitation coil 51 is disposed with arch cores 52 removed therefrom. FIG. 6C is a partially enlarged view of the induction heater 50 of FIG. 6B, illustrating a spacer 57.

In the fixing device 40 according to the first embodiment, the side cores 54 are integrally inserted in the case 55. Accordingly, the spacer 57 such as a rib can be provided on the side cores 54 without requiring additional components such as a core holder. Moreover, the gap size is determined by the height of the spacer 57, instead by a typical way of changing the size of the arch cores 52 greatly different from each other in size. Accordingly, an uneven temperature distribution can be prevented with low production costs.

Referring to FIGS. 7A through 10, descriptions are given below of four examples of the spacer 57.

Figure 7A:
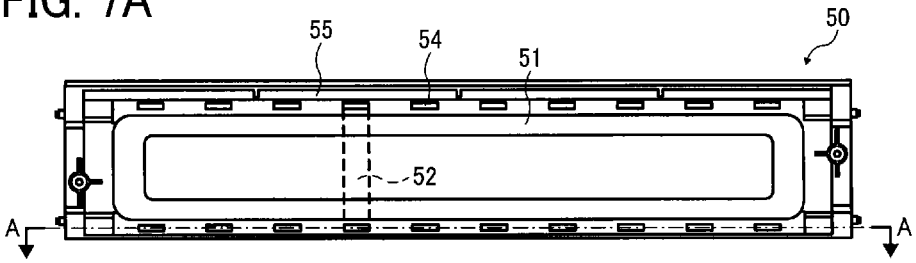
FIG. 7A is a top view of the induction heater of FIG. 4.
Figure 7B:
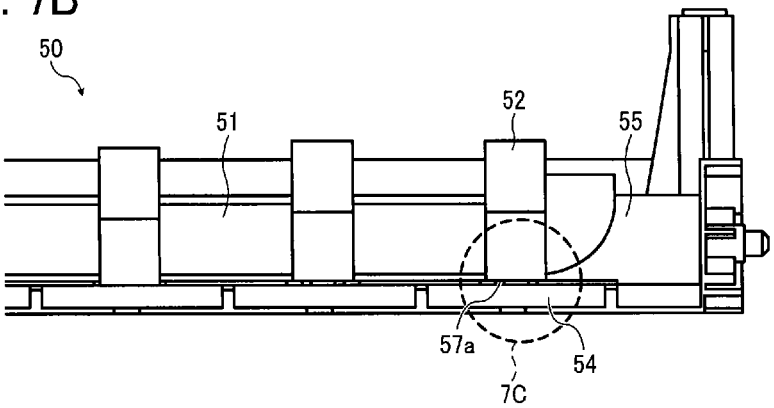
FIG. 7B is a partial sectional view of the induction heater of FIG. 7A along a line A.
Figure 7C:
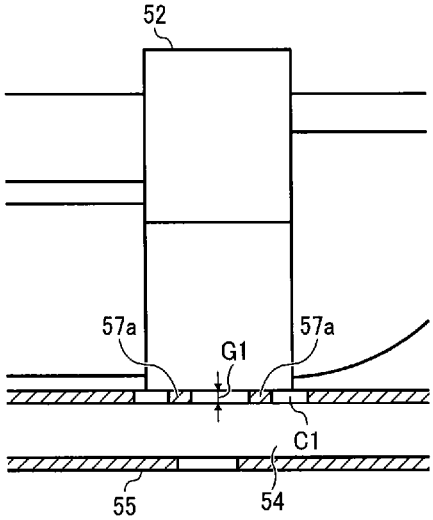
FIG. 7C is a partially enlarged view of the induction heater of FIG. 7B, illustrating a spacer according to a first example.

Referring now to FIGS. 7A, 7B, and 7C, a description is given of a spacer 57*a* according to a first example.

FIG. 7A is a top view of an induction heater 50 installable in the fixing device 40 according to the first embodiment, illustrating a portion in which an excitation coil 51 is disposed. FIG. 7B is a sectional view of the induction heater 50 of FIG. 7A along a line A. FIG. 7C is a partially enlarged view of the induction heater 50 of FIG. 7B, illustrating the spacer 57*a* according to the first example. It is to be noted that FIG. 7A illustrates a single arch core 52 indicated by a broken line. Other arch cores 52 are removed from the induction heater 50 for simplicity.

According to the first example, the spacer 57*a* is provided between an arch core 52 and a side core 54 that is integrally inserted in a case 55. The spacer 57*a* contains a resin material that is used in the case 55. As illustrated in FIG. 7C, a gap G1 is created between the arch core 52 and the side core 54 according to the height of the spacer 57*a*. A hole (or notch) C1 is provided on each side of the spacer 57*a*, thus formed as illustrated in FIGS. 6B and 6C.

Figure 8A:
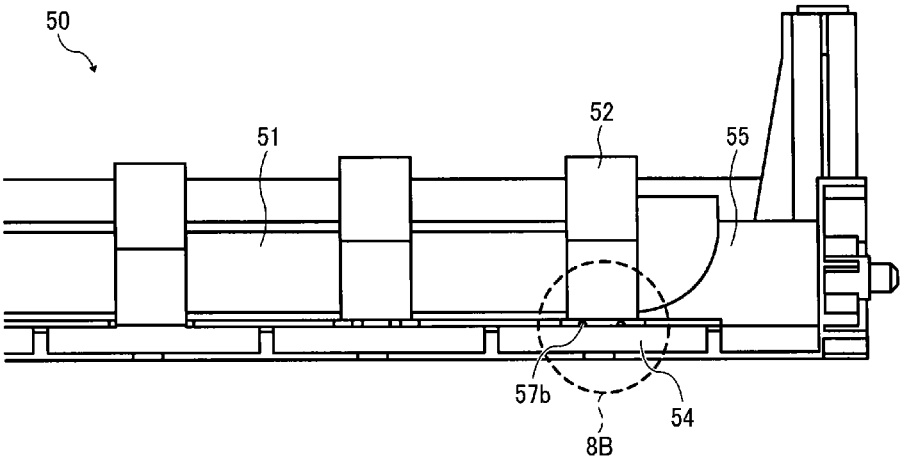
FIG. 8A is a partial side view of the induction heater of FIG. 4.
Figure 8B:
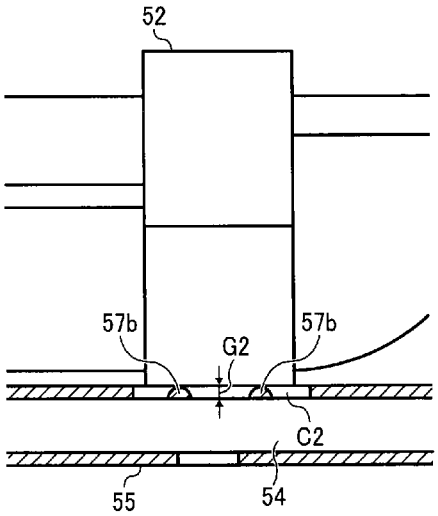
FIG. 8B is a partially enlarged view of the induction heater of FIG. 8A, illustrating a spacer according to a second example.

Referring now to FIGS. 8A, and 8B, a description is given of a spacer 57*b* according to a second example.

FIG. 8A is a sectional view of an induction heater 50 installable in the fixing device 40 according to the first embodiment, illustrating a portion in which an excitation coil 51 is disposed. FIG. 8B is a partially enlarged view of the induction heater 50 of FIG. 8A, illustrating the spacer 57*b* according to the second example.

According to the second example, the spacer 57*b* is different from the spacer 57*a* only in the shape. Specifically, the spacer 57*b* has an arch-shaped cross section. A gap G2 is created between an arch core 52 and a side core 54 according to the height of the spacer 57*b*. A hole (or notch) C2 is provided on each side of the spacer 57*b*, thus formed as illustrated in FIGS. 6B and 6C.

Since the spacer 57*b* has the arch-shaped cross section, an accurate peak height of the spacer 57*b* is obtained to determine the size of the gap G2. Accordingly, formation of a die of a case 55 is facilitated compared to obtaining the accuracy of an entire surface. Consequently, the case 55 can be formed with the spacer 57*b* having a precise height, thereby forming an appropriate size of gap G2. The spacer 57*b* having a precise height can enhance the uniformity of temperature distribution in the longitudinal direction of the induction heater 50 (i.e., axial direction of the heating roller 41).

Figure 9A:
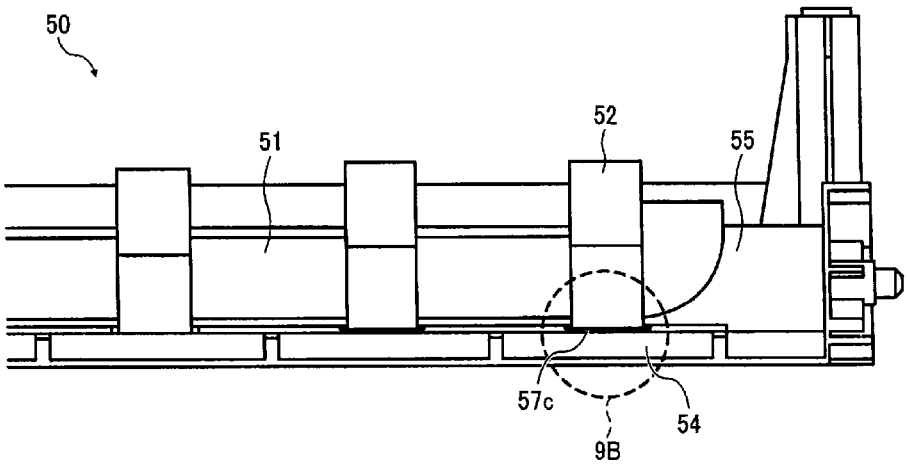
FIG. 9A is a partial side view of the induction heater of FIG. 4.
Figure 9B:
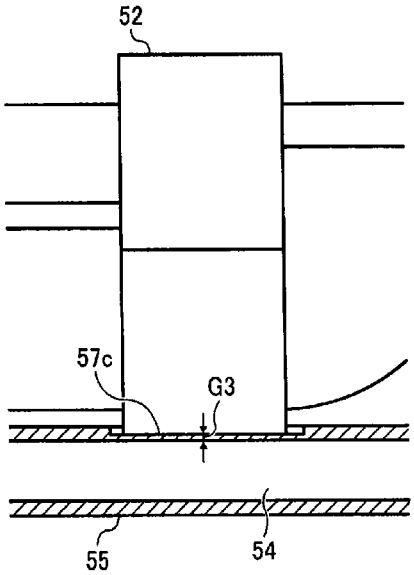
FIG. 9B is a partially enlarged view of the induction heater of FIG. 9A, illustrating a spacer according to a third example.

Referring now to FIGS. 9A and 9B, a description is given of a spacer 57*c* according to a third example.

FIG. 9A is a sectional view of an induction heater 50 installable in the fixing device 40 according to the first embodiment, illustrating a portion in which an excitation coil 51 is disposed. FIG. 9B is a partially enlarged view of the induction heater 50 of FIG. 9A, illustrating the spacer 57*c* according to the third example.

According to the third example, the spacer 57*c* is entirely covered by a resin material that is used in a case 55 without a clearance in the spacer 57*c*. A gap G3 is created between an arch core 52 and a side core 54 according to the thickness of the spacer 57*c*.

As described above, the spacer 57*a* and the spacer 57*b* have the holes (or notches) C1 and C2, respectively, on each side thereof, thus formed as illustrated in FIG. 6C. The side core 54 is exposed via the holes (or notches) C1 or C2. Whereas, no hole (or notch) is provided on either side of the spacer 57*c*. The arch core 52 and the side core 54 face each other via the resin material covering the entire spacer 57*c*. In other words, the side core 54 is not exposed. Accordingly, if the side core 54 is broken due to temperature changes over time, the spacer 57*c* can prevent scattering of broken pieces of the side core 54.

Figure 10:
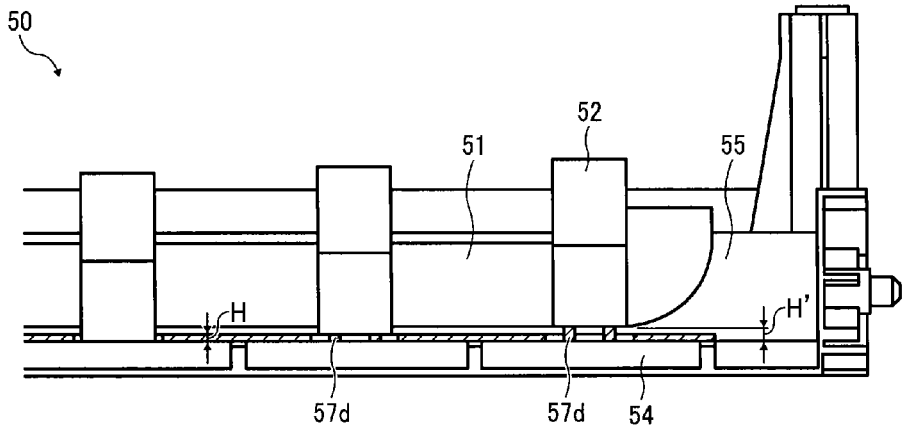
FIG. 10 is a partial side view of the induction heater of FIG. 4, illustrating a spacer according to a fourth example.

Referring now to FIG. 10, a description is given of spacers 57*d* according to a fourth example.

FIG. 10 is a sectional view of an induction heater 50 installable in the fixing device 40 according to the first embodiment, partially illustrating a portion in which an excitation coil 51 is disposed.

According to the fourth example, the height of the spacers 57*d* is determined individually for each arch core 52. The induction heater 50 may partially have a higher or lower temperature in the longitudinal direction thereof (i.e., axial direction of the heating roller 41). To obtain an uniform temperature distribution in the longitudinal direction of the induction heater 50, the height of the spacers 57*d* is determined for each arch core 52. Specifically, the height of the spacers 57*d* is determined to create a larger gap in a portion having a higher temperature, and to create a smaller gap in a portion having a lower temperature. Such a determination can enhance the uniformity of temperature distribution. It is to be noted that some of the spacers 57*d* may have the same height.

In FIG. 10, a height H' of a spacer 57*d* contacted by an endmost arch core 52 is larger than a height H of a spacer 57*d* contacted by an arch core 52 disposed next to the endmost arch core 52. In other words, a relation of H'>H is satisfied. Thus, the height of the spacers 57*d* is determined for each arch core 52. Accordingly, the gaps between the arch cores 52 and side cores 54 are different from each other in size.

FIG. 10 illustrates the spacers 57*d* in the form of the spacer 57*a* according to the first example. Alternatively, the spacers 57*d* may be in the form of the spacer 57*b* according to the second example, or the spacer 57*c* according to the third example. In other words, the spacers 57*d* may be in any form according to the foregoing example as long as the height of the spacers 57*d* is determined for each arch core 52.

According to the foregoing embodiment and examples, the side cores 54 are integrally inserted in the case 55 serving as a coil holder. In addition, a spacer (e.g., spacer 57*a*) is provided in the joining portion or close-facing portion located between an arch core 52 and a side core 54 to create a gap (e.g., gap G1) between the arch core 52 and the side core 54. The spacer contains a resin material that is used in the case 55. In such a configuration, the case 55 is used to create gaps between the arch cores 52 and the side cores 54, thereby defining the sizes of the gaps, instead of using additional components to provide such gaps between the arch cores 52 and the side cores 54. Moreover, such a configuration does not cause a difference in size of the gaps regardless of a difference in size of the arch cores 52. Accordingly, the uniformity of temperature distribution can be enhanced without requiring additional components and assembly time.

A spacer (e.g., spacer 57*b*) having an arch-shaped cross-section enhances the accuracy of size of a gap (e.g., gap G2) created by the spacer (i.e., accuracy of height of the spacer). Accordingly, the size of the gap is stabilized and the uniformity of temperature distribution is enhanced. Moreover, yields of components increased, resulting in reduction of production costs.

A spacer (e.g., spacer 57*c*) including a resin material is provided to fill the joining portion or close-facing portion located between the arch core 52 and the side core 54. In such a configuration, if the side core 54 inserted in the case 55 is broken due to a difference in thermal expansion between the side core 54 and the case 55 caused by heat cycles performed over time, scattering of broken pieces of the side core 54 can be prevented.

The height of spacers (e.g., spacers 57*d*), is determined for each arch core 52 to determine individual sizes of the gaps between the arch cores 52 and the side cores 54, thereby enhancing the uniformity of temperature distribution. Moreover, the gap sizes are determined only according to the height of the spacers of the case 55. Such a configuration obviates use of different sizes of arch cores 52 and additional components.

The spacers according to the foregoing examples are not limited to the fixing device 40 according to the first embodiment, but can also be applied to a fixing device 40 employing a heat roll system.

Figure 11:
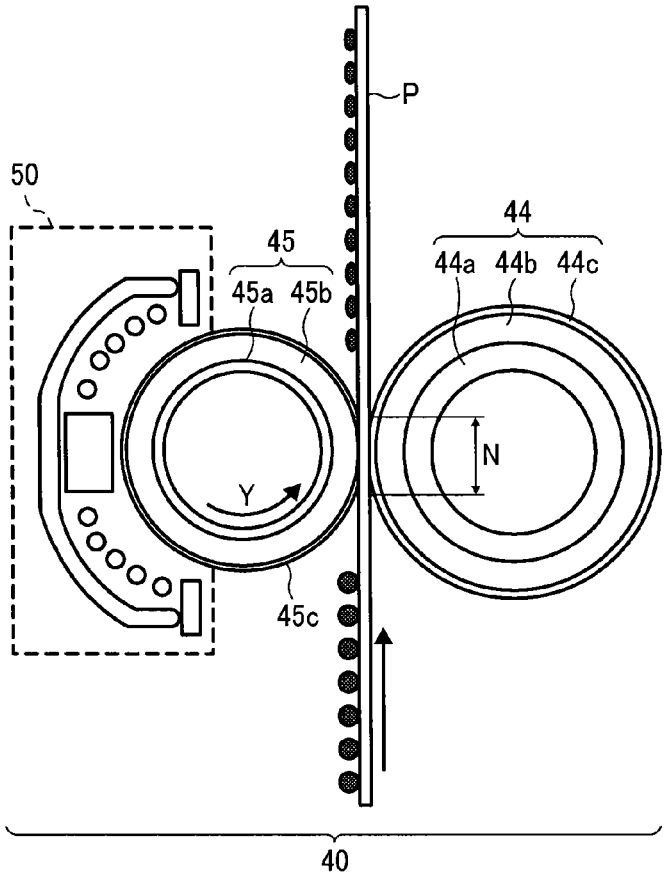
FIG. 11 is a sectional view of a fixing device according to a second embodiment.

Referring now to FIG. 11, a description is given of the fixing device 40 according to a second embodiment, employing the heat roll system.

FIG. 11 is a sectional view of the fixing device 40 according to the second embodiment.

The fixing device 40 includes, e.g., a fixing roller 45 serving as a fixing member, and an induction heater 50 to heat the fixing roller 45. The fixing device 40 has the same configuration as the fixing device 40 of FIG. 2, except that the fixing device 40 according to the second embodiment has the fixing roller 45 serving as a fixing member. According to the second embodiment, the fixing roller 45 serves as a fixing member and as a heat generation member to generate heat by being heated by the induction heater 50.

The fixing roller 45 according to the second embodiment has an outer diameter of about 30 mm to about 40 mm. The fixing roller 45 includes, e.g., a metal core 45*a*, an elastic layer 45*b*, a heat generation layer 45*c*, and a release layer. The elastic layer 45*b*, the heat generation layer 45*c*, and the release layer rest on the metal core 45*a* in this order from the metal core 45*a*. The fixing roller 45 rotates in a direction indicated by an arrow Y (i.e., counterclockwise direction) in FIG. 11. The fixing roller 45 is heated by the induction heater 50, and then heats and fuses a toner image formed on a sheet P conveyed.

The induction heater 50 of the fixing device 40 according to the second embodiment has the same configuration and operation as the induction heater 50 of the fixing device 40 according to the first embodiment. Each of the spacers 57 according to the foregoing examples can be applied to the fixing device 40 according to the second embodiment. Hence, a specific description of the induction heater 50 is herein omitted.

It is to be noted that the number of constituent elements and their locations, shapes, and so forth are not limited to any of the structure for performing the methodology illustrated in the drawings.

For example, sizes and shapes of the components of the induction heater can be appropriately determined according to the embodiments of this disclosure. In addition, the induction heater may contain any appropriate materials.

It is to be noted that the fixing device and the image forming apparatus may be any fixing device and image forming apparatus as long as the spacer according to the foregoing examples is applicable to the fixing device and the image forming apparatus. The image forming apparatus is not limited to a copier or a printer. Alternatively, the image forming apparatus may be a facsimile machine or a multifunction device having two or more of copying, printing, scanning, facsimile, plotter, and other functions.

This disclosure has been described above with reference to specific embodiments. It is to be noted that this disclosure is not limited to the details of the embodiments described above, but various modifications and enhancements are possible without departing from the scope of the invention. It is therefore to be understood that this disclosure may be practiced otherwise than as specifically described herein. For example, elements and/or features of different illustrative embodiments may be combined with each other and/or substituted for each other within the scope of the present invention.

What is claimed is:

1. A fixing device comprising:

a rotatable fixing member, comprising one of a roller and a belt;

a pressing member to press against the fixing member; and an induction heater serving as a heating source to heat the fixing member, the induction heater including:

an excitation coil to inductively heat a heat generation layer;

ferromagnetic cores to form a continuous magnetic path to direct magnetic flux arising from the excitation coil to a predetermined position; and a holder to hold the excitation coil and the ferromagnetic cores, the ferromagnetic cores including multiple arch cores disposed facing an outer surface of the heat generation layer with the excitation coil interposed therebetween and multiple side cores disposed outside the excitation coil in a longitudinal direction of the induction heater so as to face both ends of each of the multiple arch cores, the multiple side cores integrally inserted in the holder, the holder including a spacer, the spacer containing a resin material used in the holder and provided in a close-facing portion located between at least one of the multiple arch cores and at least one of the multiple side cores to form a fixed gap, and the spacer defines a size of the fixed gap between the at least one of the multiple arch cores and the at least one of the multiple side cores with respect to a height direction of the spacer.

2. The fixing device according to claim 1, wherein the spacer has an arch-shaped cross-section.

3. The fixing device according to claim 1, wherein the close-facing portion located between the at least one of the multiple arch cores and the at least one of the multiple side cores is entirely covered by the spacer.

4. The fixing device according to claim 1, wherein a height of the spacer is determined for each one of the multiple arch cores.

5. The fixing device according to claim 1, wherein the rotatable fixing member has the heat generation layer.

6. The fixing device according to claim 1, further comprising a heat generation member to support the rotatable fixing member, wherein the heat generation layer is provided in the heat generation member and inductively heated by the excitation coil to heat the rotatable fixing member.

7. An image forming apparatus comprising the fixing device according to claim 1.

8. The fixing device according to claim 1, wherein at least a portion of the spacer that is between the at least one of the multiple arch cores and the at least one of the multiple side cores includes at least one of a hole, a notch, and an indented area.

* * * * *